US007210218B2

(12) United States Patent
Weber et al.

(10) Patent No.: US 7,210,218 B2
(45) Date of Patent: May 1, 2007

(54) METHOD FOR FABRICATING ELECTRICAL CORE SHEET ASSEMBLIES

(75) Inventors: Benjamin Weber, Winterberg (DE); Thomas J. Lanoue, Cary, NC (US)

(73) Assignee: ABB T&D Technologies Ltd., Zürich (CH)

( * ) Notice: Subject to any disclaimer, the term of this patent is extended or adjusted under 35 U.S.C. 154(b) by 451 days.

(21) Appl. No.: 10/190,149

(22) Filed: Jul. 3, 2002

(65) Prior Publication Data

US 2003/0005571 A1 Jan. 9, 2003

(30) Foreign Application Priority Data

Jul. 5, 2001 (DE) ..... 101 32 719

(51) Int. Cl.
*H01F 3/02* (2006.01)

(52) U.S. Cl. ..... 29/604; 29/602.1; 29/609; 29/841; 29/417; 336/219; 310/216; 264/272.19

(58) Field of Classification Search ..... 29/602.1, 29/604, 609, 596, 841, 855, 412, 417, 827, 29/603.16; 438/26, 33; 336/219; 310/216, 310/217; 264/272.19, 272.2
See application file for complete search history.

(56) References Cited

U.S. PATENT DOCUMENTS 2,658,264 A * 11/1953 Epelboin ..... 29/609 X
3,614,830 A * 10/1971 Bate et al. ..... 29/603.16
4,665,329 A * 5/1987 Raschbichler ..... 310/216 X

FOREIGN PATENT DOCUMENTS

| | | | |
|---|---|---|---|
| DE | 881 547 | 3/1951 | |
| DE | 1 018 172 | 10/1957 | |
| JP | 3-278505 | * 11/1989 | ..... 264/272.2 |

OTHER PUBLICATIONS

Lin et al., "Cast Thin Amorphous Mtal for Stacked Core Power Transformers", Westinghouse ABB Power T & D Co., IEEE Proceedings of the 19th 1989 EEIC/ICWA Exposition, Electrical Electronics Insulation Conference, Sep. 1989, pp. 154-157.*

* cited by examiner

*Primary Examiner*—A. Dexter Tugbang
(74) *Attorney, Agent, or Firm*—Laurence A. Greenberg; Werner H. Stemer; Ralph E. Locher

(57) ABSTRACT

A method of fabricating electrical core sheet assemblies such as transformer limbs, transformer yokes, and transformer cores, includes the steps of first cutting electrical core sheets, whose main surfaces have been provided with an anti-corrosion layer, into a desired shape. The side surfaces of the cut core sheets are first provided with an anti-corrosion layer, before the cut core sheets are assembled into the desired core sheet assembly.

4 Claims, 1 Drawing Sheet

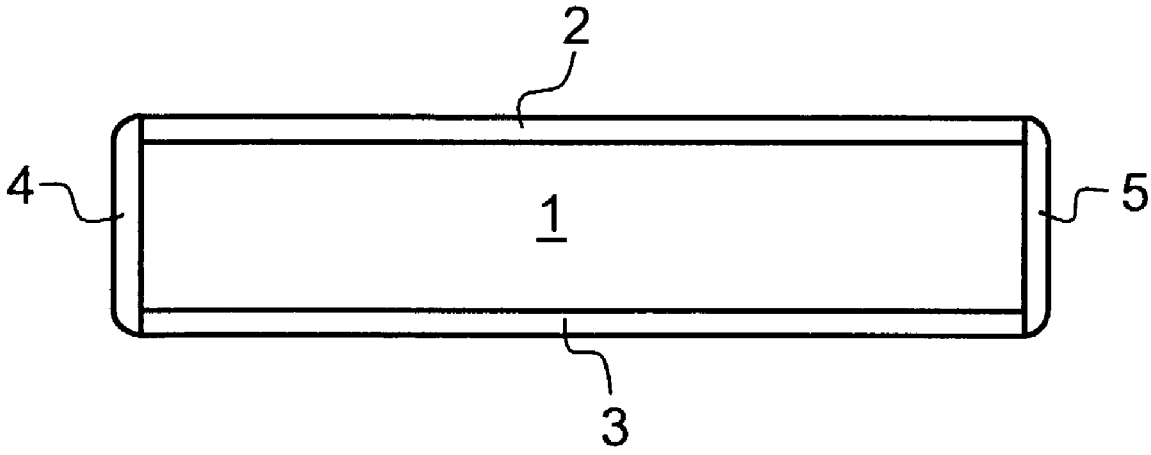
2
4
1
5
3

METHOD FOR FABRICATING ELECTRICAL CORE SHEET ASSEMBLIES

BACKGROUND OF THE INVENTION

Field of the Invention

The invention relates to a method for fabricating electrical core sheet assemblies such as transformer limbs, transformer yokes and transformer cores. The electrical core sheets, whose main surfaces have been provided with an anti-corrosion layer, are cut into the desired shape.

In transformer core fabrication, the electrical core sheets (also referred to as core plates) are customarily cut into the desired shape at the outset. The two main surfaces of the utilized core sheets are already provided with an anti-corrosion layer by the sheet manufacturer. Next, the cut core sheets are assembled so as to form the transformer limbs and the bottom transformer yoke. Next, the side surfaces of these transformer limbs and of the bottom transformer yoke must be provided with an anti-corrosion layer. The winding is then installed around the transformer limbs; that is to say, the transformer limbs are wrapped. In the next step, the cut core sheets of the top transformer yoke are mounted. The side surfaces of the top transformer yoke are then provided with an anti-corrosion layer. The final production of the transformer then occurs.

In that method, additional manual production steps are required for coating the side surfaces of the transformer limbs and the transformer yokes, in particular.

SUMMARY OF THE INVENTION

It is accordingly an object of the invention to provide a method for fabricating core sheet assemblies, which overcomes the above-mentioned disadvantages of the heretofore-known devices and methods of this general type and which is simplified in comparison with the prior methods for producing electrical core sheet assemblies.

With the foregoing and other objects in view there is provided, in accordance with the invention, a method of fabricating an electrical core sheet assembly, such as a transformer limb, a transformer yoke, or a transformer core. The method comprises the following method steps:

providing electrical core sheets with main surfaces having an anti-corrosion layer;

cutting the electrical core sheets into a desired shape to form cutting edges at lateral surfaces of the core sheets;

providing the cutting edges with an anti-corrosion layer; and subsequently assembling the cut core sheets into the core sheet assembly.

In other words, the objects of the invention are achieved in that the side surfaces (that is to say, the cutting edges) of the cut core sheets are first provided with an anti-corrosion layer, and only then are the cut core sheets assembled into the desired core sheet assembly.

In accordance with an added feature of the invention, the anti-corrosion layer is applied by rolling, spreading, or spraying.

In accordance with a concomitant feature of the invention, a two-component epoxy resin system is used.

The advantages that can be achieved with the invention consist particularly in the simplification of the production of electrical core sheet assemblies by the providing of the all-round coating of cut core sheets prior to the assembling of the core sheet assembly, by virtue of the fact that fewer production steps are required overall. The coating process, i.e. the application of the anti-corrosion layer to the cutting edges, can be performed fully automatically, which improves the quality of the anti-corrosion layers compared to a manual coating technique.

Other features which are considered as characteristic for the invention are set forth in the appended claims.

Although the invention is illustrated and described herein as embodied in a method for fabricating electrical core sheet assemblies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a sectional view of a section taken through a core sheet.

DESCRIPTION OF THE PREFERRED EMBODIMENTS

Referring now to the sole FIGURE of the drawing in detail, there is shown a cross-section of an electrical core sheet 1 that has been cut into a desired shape. The two main surfaces of the core sheet 1 have already been provided with anti-corrosion layers 2 and 3 at the manufacturer's. In addition, all lateral edges (i.e. cut edges) of the core sheet 1 are provided with anti-corrosion layers 4 and 5 following the cutting of the core sheet and before the assembly of several core sheets into a core sheet assembly. That is, each individual core sheet is provided with all-around corrosion protection.

In the fabrication of a core sheet assembly, particularly a transformer core, the electrical core sheets 1 are first cut into the desired shape. As described above, after the core sheets 1 are cut, all side edges (cutting edges) of the core sheets 1 are provided with anti-corrosion layers 4 and 5. Next, the cut core sheets 1 are assembled, forming the transformer limbs and the bottom transformer yoke. The winding is then placed around the transformer limbs; i.e., the transformer limbs are wrapped. In the next step, the cut core sheets of the top transformer yoke are mounted. The final production of the transformer then occurs.

The coating of the cut edges of the core sheets is performed automatically immediately following the cutting of the core sheets in the core cutting apparatus, with the coating material being rolled, spread, or sprayed on. A two-component epoxy resin system with sufficient temperature resistance can be used as the coating material.

We claim:

1. A method of fabricating an electrical core sheet assembly, which comprises:

providing individual electrical core sheets with main surfaces having a main-surface anti-corrosion layer;

cutting the individual electrical core sheets into a desired shape to form cutting edges at lateral surfaces of the individual core sheets;

providing the cutting edges of each of the individual electrical core sheets with a cutting-edge anti-corrosion layer while the individual electrical core sheets are separated from one another; and subsequently assembling the individual cut core sheets into the core sheet assembly.

2. The method according to claim 1, wherein the assembling step comprises assembling the cut core sheets into an assembly selected from the group consisting of a transformer limb, a transformer yoke, and a transformer core.

3. The method according to claim 1, which comprises applying the cutting-edge anti-corrosion layer with a process selected from the group consisting of rolling, spreading, and spraying.

4. The method according to claim 1, which comprises utilizing a two-component epoxy resin system.

* * * * *